United States Patent [19]

Secrist et al.

[11] Patent Number: 4,472,258

[45] Date of Patent: Sep. 18, 1984

[54] ANODE FOR MOLTEN SALT ELECTROLYSIS

[75] Inventors: Duane R. Secrist, Elizabethton; James M. Clark, Johnson City, both of Tenn.

[73] Assignee: Great Lakes Carbon Corporation, New York, N.Y.

[21] Appl. No.: 491,089

[22] Filed: May 3, 1983

[51] Int. Cl.[3] ..... C25B 11/04

[52] U.S. Cl. ..... 204/292; 204/293; 75/234

[58] Field of Search ..... 204/293, 292, 291, 242; 264/61; 75/230, 232, 234, 246

[56] References Cited

U.S. PATENT DOCUMENTS 4,155,758 5/1979 Evans ..... 75/232
4,204,863 5/1980 Schreiner ..... 75/234

FOREIGN PATENT DOCUMENTS 8102027 7/1981 European Pat. Off. ..... 204/242

*Primary Examiner*—John F. Niebling
*Attorney, Agent, or Firm*—Adrian J. Good

[57] ABSTRACT

An electrode for an electrochemical cell comprising a variable cermet composition, the portion in contact with the electrolyte having a relatively high ceramic content for maximum corrosion resistance and the portion attached to the external electrical circuit having a relatively high metal content to facilitate an electrical connection. Preferred metals are Ni, Cu, Fe, and Cr; and preferred ceramics are ferrites.

4 Claims, 1 Drawing Figure

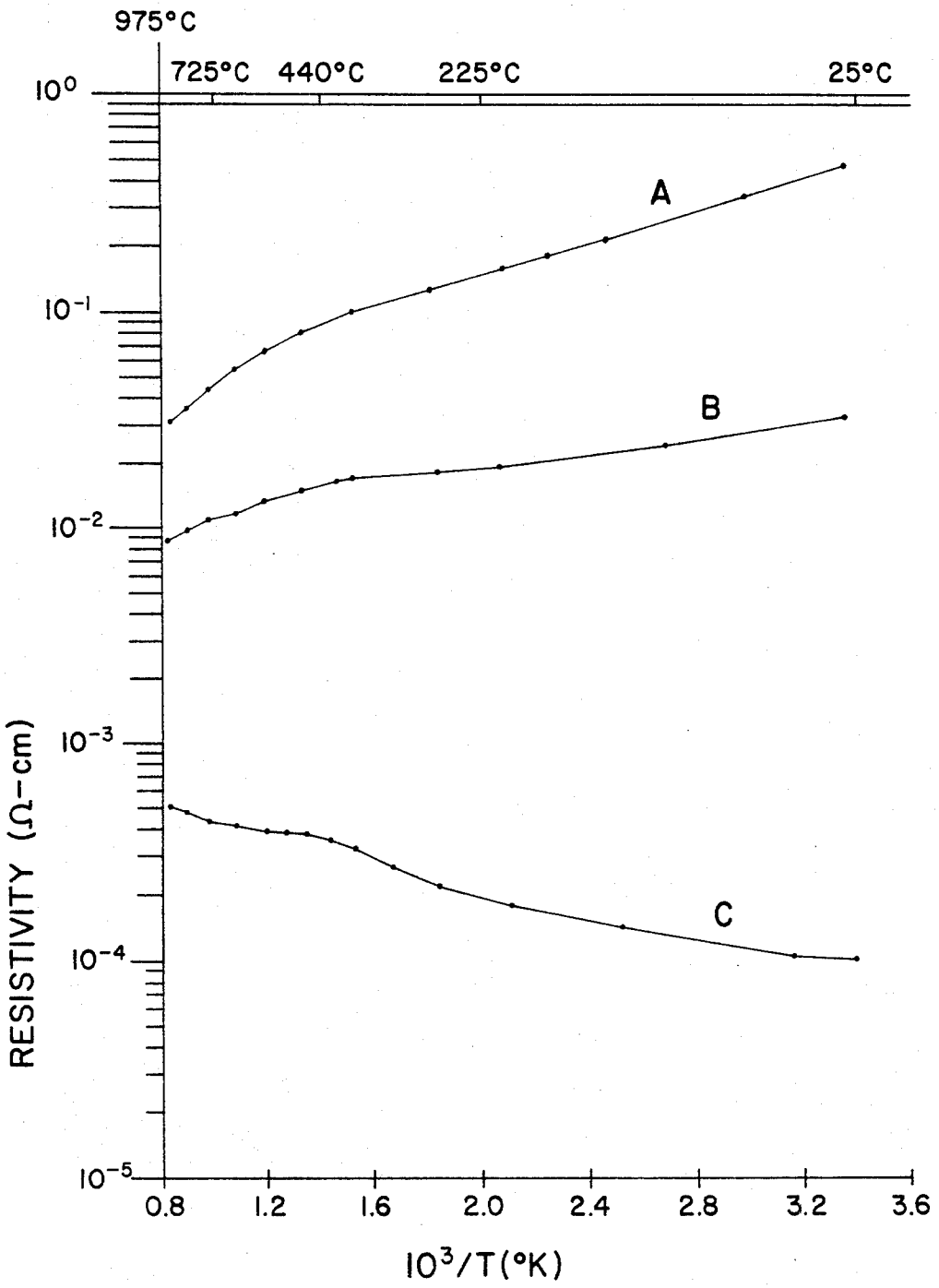
· Fig. 1 ·

ANODE FOR MOLTEN SALT ELECTROLYSIS

BACKGROUND OF THE INVENTION

Aluminum is produced in Hall-Heroult cells by the electrolysis of alumina in molten cryolite, using conductive carbon electrodes. During the reaction the carbon anode is consumed at the rate of approximately 450 kg/mT of aluminum produced under the overall reaction $$2Al_2O_3 + 3C \xrightarrow[Na_3AlF_6]{940°-1000° C.} 4Al + 3CO_2.$$

The problems caused by the consumption of the anode carbon are related to the cost of the anode consumed in the reaction above and to the impurities introduced to the melt from the carbon source. The petroleum cokes used in the anodes generally have significant quantities of impurities, principally sulfur, silicon, vanadium, titanium, iron and nickel. Sulfur is oxidized to its oxides, causing particularly troublesome workplace and environmental pollution. The metals, particularly vanadium, are undesirable as contaminants in the aluminum metal produced. Removal of excess quantities of the impurities requires extra and costly steps when high purity aluminum is to be produced.

If no carbon is consumed in the reduction the overall reaction would be $2Al_2O_3 \rightarrow 4Al + 3O_2$ and the oxygen produced could theoretically be recovered, but more importantly no carbon is consumed at the anode and no contamination of the atmosphere or the product would occur from the impurities present in the coke.

Attempts have been made in the past to use non-consumable anodes with little apparent success. Metals either melt at the temperature of operation, or are attacked by oxygen or by the cryolite bath. Ceramic compounds such as oxides with perovskite and spinel crystal structures usually have too high electrical resistance or are attacked by the cryolite bath.

One of the problems arising in the development of conductive ceramic anodes has been caused by the difficulty of making a durable electrical connection between the anode and the current conductor. Previous efforts in the field have produced connectors, primarily of metals such as silver, copper, and stainless steel. Can, U.S. Pat. No. 3,681,506, discloses a resilient metal washer held in place to form an electrical connection. Davies, U.S. Pat. No. 3,893,821, discloses a contact material containing Ag, La, $SrCrO_3$ and CdO. Douglas et al., U.S. Pat. No. 3,922,236, disclose a contact material containing Ag, Cu, La, and $SrCrO_3$. Fletcher, U.S. Pat. No. 3,990,860, discloses cermet compositions containing stainless steel or Mo in a matrix of $Cr_2O_3$ and $Al_2O_3$. Shida et al., U.S. Pat. No. 4,141,727, disclose contacts of Ag, $Bi_2O_3$, $SnO_2$ and Sn. Schirnig et al., U.S. Pat. No. 4,247,381, disclose an electrode useful for $AlCl_3$ electrolysis comprising a graphite pipe, a metallic conductor with a melting point below the bath temperature, and a protective ceramic pipe surrounding the former. West German No. 1,244,343, U.S. Ser. No. 729,621, discloses borides or carbides of Ti, Zr, Ta, or Nb cast to Al using a flux of $Li_3AlF_6$, $Na_3AlF_6$ and NaCl. Alder, U.S. Pat. No. 4,357,226, discloses an anode assembly for a Hall cell comprising individual units mechanically held together by a clamping arrangement. Our U.S. Pat. No. 4,443,314, discloses a cermet anode connector.

In non-consumable anodes, ceramics such as stannic oxide, spinels, perovskites and various cermets are principal materials under study. A cermet is a composite material containing both metal and ceramic phases.

SUMMARY OF THE INVENTION

A cermet composition is defined as one consisting of both metallic and ceramic phases. The conventional method of preparing cermet compositions is to mix metal and ceramic powders, cold press a preform, and sinter the preform at an elevated temperature in a controlled atmosphere. Alternatively, the cermet may be prepared by hot pressing wherein the pressing and sintering operations are performed concomitantly. Cermets have high electrical conductivity in comparison to ceramic compositions and good corrosion resistance when compared to metals. The reaction bonding which takes place between the cermet constituents during heat treatment alters the properties of the cermet in a synergistic fashion such that an improvement is realized over either of the metal or ceramic raw materials.

Our invention is a cermet non-consumable electrode useful for molten salt electrolysis and is particularly suitable as an anode for the electrolysis of alumina in a Hall-Heroult cell. The electrode functions as the active electrolytic element and is well adapted to carry current from the electrode current source to the electrolyte. The electrode itself is a metal-containing cermet of variable composition, with one end adapted for contact with the external electrical circuit having a relatively high metal content facilitating a brazed connection and low resistivity, with a high content of the ceramic component at the end in contact with the electrolyte for corrosion resistance.

It has been shown in Hall cell experiments in our laboratory that optimum performance of the anode is obtained when the portion of the anode in contact with the electrolyte has a metal content less than 25% by volume. The portion of the anode which is to be brazed to the current conducting member must be wetted by the braze metal and should, therefore, have a metal content greater than 30 volume % and preferably greater than 40 volume %. Both of these requirements can be met in a monolithic anode by making an anode of graded composition with the portion in contact with the electrolyte having preferably at least 75% by vol. ceramic and the portion in contact with and brazed to the anode riser bar or other current source having at least 40% by vol. metal. The differentiation between the volume fractions of metal and ceramic phases is done by gradient, filling the mold in stages with mixtures of two or more of the varied compositions sequentially. An anode prepared as described has the additional advantage that ohmic losses are reduced during operation of the anode as a result of the increasingly higher metal content in the direction of the current member.

For use in a Hall-Heroult cell, a cermet must have good conductivity across a wide temperature range, good oxidation stability, and high corrosion resistance. Metal-metal oxide combinations are desirable for long term use, but cermets with a non-oxide ceramic phase may also be useful provided the oxide which forms on the surface of the cermet during operation at high temperature is sufficiently electrically conductive and corrosion resistant.

The cermets are prepared conventionally by blending the ceramic powder with a metal. A cermet anode may be fabricated by sequentially forming layers of ceramic and metal powder mixtures with varying compositions and isostatically pressing at about $5-30\times10^4$ Pa to yield a graded body. The graded body is then sintered in an inert atmosphere at a temperature above about 1100° C. effective to produce a physically strong part with low porosity, 8 vol. % or lower, and good electrical conductivity across a wide temperature range.

Typically, cermets with ≧30 vol. % metal content exhibit conductivities approaching that of the metal phase while maintaining high corrosion resistance, provided that the cermet body is impervious, i.e., contains less than approximately 8 vol. % porosity.

Our method may be used to produce electrodes varying in metal content from 0–100% across their length, which would not be cermets at the extremities but sintered metal and ceramic compositions varying to cermets either continuously or in graded steps.

We may also vary the composition by using different metals or alloys at the two opposite portions, the metals most commonly used being Ni, Cu, Fe, and Cr. Thus, we may in some instances use a Cu-ceramic cermet at the end connected to the current source and an Ni-ceramic cermet at the electrolyte-contacting portion for corrosion resistance. We may also vary the ceramic used from those highly corrosion resistant to those more conductive, or varying in other properties.

Our electrodes may have many other applications in addition to those in the Hall-Heroult cell, as in the production of the electrolytic elements and compounds, e.g., Mg, Cu, Zn, Na, Cl, NaOH, Ag, Au, and Pt are produced or refined electrolytically, and acrylonitrile is dimerized to adiponitrile. Our electrodes may also be useful in primary cells, i.e., fuel cells for the conversion of chemical to electrical potential, which have many similarities to molten salt electrolysis as far as exposure to corrosive materials and temperatures is concerned, both having the needs for electrical conductivity and connectability.

BRIEF DESCRIPTION OF THE DRAWINGS

FIG. 1 shows a plot of log resistivity versus reciprocal temperature for the cermets.

DETAILED DESCRIPTION OF THE INVENTION

Cermet bodies comprising Ni and MnZn ferrite containing 16–40% by volume Ni metal were fabricated. The MnZn ferrite powder used was prepared by conventional wet milling of $MnCO_3$, ZnO, and $Fe_2O_3$. The dried powders were calcined in air at 1000° C. for 2 hours to yield a final composition corresponding to 52 mole % $Fe_2O_3$, 25 mole % MnO, and 23 mole % ZnO. The cermet compositions were mixed by dry blending MnZn ferrite powder with one and 40 micron size nickel powders. Samples were then isostatically pressed and sintered in vacuum or nitrogen for 2–24 hours at 1225° C. to produce a dense, low porosity article. Examination of the microstructures revealed one nickel-iron metal phase and three ceramic phases consisting of mixed ferrites or solid solutions of Mn ferrite, Ni ferrite, and Zn ferrite. The x-ray diffraction lines most closely matched those of nickel zinc ferrite, with several strong lines unidentifiable.

Examples 1–3 below are electrodes of uniform composition while Examples 4–7 are of variable composition according to the invention.

EXAMPLE 1

An anode was formed from a 16 vol. % Ni-84 vol. % $(MnZn)Fe_{2.04}O_4$ cermet by the procedure above using <40μ size (minus 325 mesh) Ni powder, having a diameter of 3.8 cm and 95% of theoretical density. It was tested for 65 hours in an aluminum reduction cell in acidic cryolite at 970° C., using a weight ratio of 1.2 $NaF/AlF_3$, with 7% $CaF_2$, saturated with $Al_2O_3$. A current density of 1 amp/cm$^2$ was imposed on the sample using the area of the tip of the anode as the basic for the current density calculation. No operating difficulties were encountered, with the anode voltage stable throughout the test. At the end of the test period, the axial dimension had lost 0.53 mm for an effective corrosion rate of 71 mm/yr.

EXAMPLE 2

The test of Example 1 was repeated using the same percentage composition with Ni powder of nominal 1μ particle diameter. After 100 hours of test, the axial corrosion rate was 66 mm/yr.

EXAMPLE 3

Cermet samples containing 16, 25, and 40 volume % Ni and the remainder MnZn ferrite were fabricated for electrical resistivity characterization. Measurements were taken over the temperature range 25°–950° C. using platinum probes and contacts in a 4-terminal arrangement. A plot of log resistivity versus reciprocal temperature for the cermets is shown in FIG. 1. The measurements were made in air. It is evident from the figure that the compositions containing 16 and 25 volume % Ni have negative temperature coefficients, characteristic of semiconducting oxides, while the 40 volume % Ni cermet has a positive temperature coefficient, indicative of metallic behavior. The internal stability of all three cermets at 950° C. in air was demonstrated by noting that the resistivities remained constant for periods ≧40 hours. The cermet containing 40 volume % Ni has a resistivity at 950° of $5\times10^{-4}\Omega\cdot$ cm, one-tenth that of anode carbon at the same temperature. A polished specimen of this cermet was examined with the electron microscope and observed to be very dense and to possess an extended internal metal network accounting for the metallic electrical properties.

EXAMPLE 4

A 3.6 cm long×3.8 cm diameter cermet anode was fabricated as follows: Cermet compositions containing 16, 25, and 40 vol. % nickel metal were prepared by dry blending one micron size metal powders with calcined powders of MnZn ferrite. A layer of the 16 vol. % Ni cermet was placed in a cylindrical mold followed, in turn, by a layer of the 25 vol. % Ni cermet and a layer of the 40 vol. % Ni cermet. To preserve the definition of the graded layers, the mold was compacted at $6.9\times10^7$ Pa in a uniaxial mechanical press prior to final isostatic pressing at $1.4\times10^8$ Pa. The green body was sintered in vacuum for 2 hours at 1225° C. to yield a 98% dense anode based on an estimated theoretical density of 6.133 g/cm$^3$. The diameter of the sintered anode varied from 3.85 cm at the high metal end to 3.70 cm at the low metal end, a difference of 4%. The differential shrinkage was accommodated with no evidence of external structural defects.

A 1.9 cm diameter 70/30 copper-nickel alloy rod was brazed to the high metal end of the anode to form a low resistance solid state connection. The brazing operation was carried out by placing the rod atop a layer of copper powder (m.p. 1083° C.) in contact with the sintered anode and firing the assembly in vacuum to 1125° C. for 30 minutes to melt the braze metal. The resulting joint was strong. Sectioning of the anode confirmed the intimate contact(low wetting angle) of the braze metal and the cermet; the layers of cermet material within the anode was strongly reaction bonded with no sign of delamination at the interfaces.

EXAMPLE 5

Nickel/MnZn ferrite cermet compositions containing 16, 22, 28, 34, and 40 vol. % Ni were prepared by dry blending the constituent powders for one hour. A graded cermet anode was formed from the powders by filling a cylindrical mold sequentially with a 3.8 cm thick layer of the 16 vol. % Ni cermet, 1.3 cm thick layers of the 22, 28, and 34 vol. % Ni cermets, and finally a 3.8 cm thick layer of the 40 vol. % Ni cermet. The molded powders were isostatically pressed at $1.4\times10^8$ Pa to form a green anode body. A 2.5 cm diameter hole, 2.5 cm deep, was drilled in the metal rich end of the anode to accommodate a metal stub. The anode was densified by sintering in vacuum for 6 hours at 1225° C.; the sample measured 7.6 cm in length and 4.2 cm in diameter. A 70/30 copper-nickel alloy stub, 1.9 cm in diameter, was brazed to the metal rich end of the anode by inserting the stub into the prepared hole, filling the annular void space around the stub with copper metal powder, and firing the complete assembly in a vacuum furnace to 1125° C. for 30 minutes to effect a solid state connection.

The integrity of the anode assembly was evaluated by exposing the anode and joint to Hall reduction cell conditions in a 24 hour test. Electrical connection of the anode to the bus bar was made by welding the anode stub to the positive current member. The tip of the anode comprising the 16 vol. % Ni/MnZn ferrite material was immersed to a depth of 2.5 cm in a melt containing $Na_3AlF_6$ and excess $AlF_3$ (1.2 weight ratio) with 7 wt. % $Al_2O_3$ and 7 wt. % $CaF_2$. The melt temperature was 970° C. The anode was electrolyzed at a current density of approximately 1 amp/cm$^2$ or 20 amps total anode current.

During the test, the temperature at the top of the anode joint was measured to be 930° C., several hundred degrees greater than that the joint is expected to experience during commercial operation. Thus the described conditions represent a severe test of the integrity of the joint. When the test was terminated, the anode assembly was observed to be in excellent condition. A continuity measurement of the joint showed that no increase in resistance had occurred during anode operation.

EXAMPLE 6

A cylindrical mold was filled with powders of two different Ni/MnZn ferrite cermet compositions with the powders segregated so that the lower half of the mold contained a 16 vol. % Ni cermet and the upper half a 40 vol. % Ni cermet. The powders were isostatically pressed at $1.4\times10^8$ Pa to yield a green anode body having a graded cermet composition. A 2.5 cm diameter hole, 2.5 cm deep, was then drilled in the metal rich end of the cermet. A 1.9 cm diameter$\times$1.0 cm thick disk of 70/30 copper-nickel alloy metal (m.p. 1240° C.) was placed in the bottom of the hole and a 1.9 cm diameter Monel 400 cylindrical stub (m.p. 1349° C.) placed on top of the disk. The complete assembly was fired in vacuum to 1225° C. and allowed to soak for 6 hours to densify the cermet anode. The temperature was then raised to 1265° C. for approximately 20 minutes to melt the braze melt after which the assembly was cooled to room temperature in 8 hours. The anode body sintered to high density and was structurally sound. The metal stub was joined securely to the sintered anode via the braze metal.

The tip of the anode was immersed to a depth of 1.9 cm in a cryolite-$CaF_2$—$Al_2O_3$ melt at 970° C. and the anode electrolyzed at 2.0 amps/cm$^2$ current density for 98.5 hours. The integrity of the anode was unaffected by the introduction of the anode into the cell, the extended electrolysis period, and the withdrawal of the anode from the cell illustrating that cermet compositions differing appreciably in metal content can be fabricated into monolithic anodes which exhibit high strength at operating temperature.

When incorporating the anode sintering and brazing steps in a single firing, as described, a knowledge of the shrinkage characteristics of the cermet material is essential in order to properly dimension the braze cavity.

EXAMPLE 7

A large cylindrical anode measuring 8 cm in diameter by 5 cm long was fabricated by sequentially forming layers of Ni/$MnZnFe_{2.04}O_4$ cermet powders containing 25.0, 32.5, and 40.0 vol. % Ni, isostatically pressing the powders at $1.4\times10^8$ Pa to form a compacted body, and sintering the body at 25° C. per hour to 1225° C. for 6 hours in nitrogen. The anode was cooled to room temperature at 25° C. per hour. The sintered anode was >95% dense and was free of structural defects. A 2.5 cm diameter by 3.8 cm long Monel 400 stub was brazed to the anode using 70/30 copper-nickel alloy as the braze metal. The stub was inserted into a 2.0 cm deep cavity in the metal rich end of the anode, the braze metal placed about the stub, and the complete assembly fired to 1265° C. in nitrogen to effect the connection to the anode.

It may be determined from the above that a non-consumable electrode for an electrochemical cell may be constructed as a physically monolithic material having a variable composition, the portion in contact with the electrolyte having high corrosion resistance and the portion connected to the external electrical circuit being wettable or brazable by a brazing composition. Thus, the end of a cermet anode in contact with cryolite in a Hall-Heroult cell is high in ceramic content, while the end in contact with the current source is high in metal content. This principle may also be used in forming electrodes, both anodes and cathodes, for other molten salt cells, such as those used for production of Al by the electrolysis of $AlCl_3$, Mg production, and in forming electrodes for electrochemical cells in general involving a corrosive electrolyte.

We claim:

1. A permanent cermet anode for use in a Hall-Heroult cell having one end attached to a current source and the other end in contact with the molten electrolyte, the improvement comprising said ends having different compositions, the end attached to the current source by a brazed connection having from 30% to 60% by volume of a metal selected from the group consisting of Cu, Ni, Fe, Cr and alloys or mixtures thereof and from 40% to 70% by volume of a ceramic component, the end in contact with the electrolyte having from 75% to 84% by volume ceramic component and from 16% to 25% by volume of a metal selected from said group of metals, said end attached to said current source having a resistivity less than $1\times10^{-3}$ ohm-cm at 950° C., and said end in contact with said electrolyte having a resistivity less than $1\times10^{-1}$ ohm-cm at 950° C. with a negative temperature coefficient of resistivity.

2. The anode of claim 1 wherein the electrolysis-adapted portion consists of at least 75% by volume of a ceramic phase and wherein said brazable portion consists of 30% to 40% by volume metallic phase.

3. The anode of claim 1 comprises of layers having 16, 22, 28, 34 and 40% by volume Ni powder and wherein the ceramic component is a MnZn ferrite.

4. The anode of claim 1 brazed to a current source at the brazable cermet end of said anode as an integral part of and concurrently with the sintering operation producing said anode.

* * * * *